US005791362A

United States Patent [19]

Seiger

[11] Patent Number: 5,791,362

[45] Date of Patent: Aug. 11, 1998

[54] SUN SHADE

[76] Inventor: Johann Seiger, DR. Kadrasgasse 15, Klagenfurt, Austria, A-9020

[21] Appl. No.: 586,888

[22] PCT Filed: May 19, 1995

[86] PCT No.: PCT/AT95/00096

§ 371 Date: Jan. 24, 1996

§ 102(e) Date: Jan. 24, 1996

[87] PCT Pub. No.: WO95/32648

PCT Pub. Date: Dec. 7, 1995

[30] Foreign Application Priority Data

| | | | |
|---|---|---|---|
| May 26, 1994 | [AT] | Austria | A 1078/94 |
| Dec. 23, 1994 | [AT] | Austria | GM 512/94 |
| Dec. 23, 1994 | [AT] | Austria | GM 513/94 |

[51] Int. Cl.[6] ..... E04H 15/04

[52] U.S. Cl. ..... 135/90; 135/115; 135/96

[58] Field of Search ..... 135/134, 115, 135/33.2, 96, 95, 90, 88.1, 88.11, 88.12, 117, 119

[56] References Cited

U.S. PATENT DOCUMENTS

| | | | |
|---|---|---|---|
| 3,584,322 | 6/1971 | McDougall | 135/134 X |
| 4,962,780 | 10/1990 | Engdahl et al. | 135/33.2 |
| 5,333,663 | 8/1994 | Eger . | |
| 5,437,298 | 8/1995 | Lin | 135/115 X |

FOREIGN PATENT DOCUMENTS

| | | | |
|---|---|---|---|
| 3101390 | 12/1982 | Germany | 135/33.2 |

*Primary Examiner*—Lanna Mai

*Attorney, Agent, or Firm*—Jacobson, Price, Holman & Stern, PLLC

[57] ABSTRACT

A sun shade (4), useful in particular to complement reclining surfaces (1), protects the skin during sun bathing against damaging solar radiation, such as UVB and UVC radiation. When the skin is exposed to sun rays, the intensive action of the UVB and UVC radiation fractions of sun light may cause not only sunburns, but also skin cancer in the long term. UVA radiation, however, which causes the desired sun tanning, is innocuous in this respect.

8 Claims, 6 Drawing Sheets

SUN SHADE

BACKGROUND OF THE INVENTION

The invention refers to a sun shade, which can be used particularly as a complement for lawn chairs and analogous products.

FIELD OF THE INVENTION

The invention's main characteristic is to protect against skin-harming radiation, such as UVB and UVC radiation during sunbathing.

DESCRIPTION OF THE RELATED ART

The main problem existing in sun exposure of the skin is that intensive action of UVB and UVC radiation fractions may not lead only to sunburn, but over the time also to skin cancer. The UVA radiation, which causes desired tanning only, is not harmful in this respect.

Materials are already known which let UVA radiation pass through and absorb UVB and UVC radiation. In principle, these materials can be produced and processed as foils with respective characteristics.

It is furthermore known to shade lying surfaces such as lawn chairs in conventional manner, for example with adjustable shading devices for the head, the body and the legs. It has for example become known from U.S. Pat. No. 6,155,366 to provide a shading device for the trunk of the body, wherein the shading consists of conventional materials being opaque to all radiation fractions of sunlight, such as thick textile materials.

Furthermore, from GB-PS 18 923 it is known to provide an adjustable device which shades only the head portion of a lawn chair or baby carriage.

In addition, U.S. Pat. No. 4,068,673 shows an independent shading device of which the angle of attachment and the height can be adjusted by respective adjustable hinges. However the shading is provided by conventional, completely impermeable materials.

Furthermore, U.S. Pat. No. 4,720,135 shows a device mounted in the bumper of a vehicle for rolling up a foil being tensible from the front bumper of a car and extending to the rear bumper, which prevents on one hand a soiling of the car by the environment in parked position and which should prevent by printed warning symbols the car from being run into when in a parked position. This device has no protective capabilities with respect to sunlight.

Because the known shading devices are always equipped with materials completely blocking the sun-light, a respective continual adjustment regarding the areas, where shading is wanted, is necessary and moreover the desired tanning without harmful side effects can take place only by an exact time regulation.

SUMMARY OF THE INVENTION

It is therefore the aim of the present invention to provide a sun shade or protective cover against the harmful UVB and UVC radiation fractions of the sun-light, which does not need an exact time limitation of the duration of exposure nor a very precise positioning of the sun shade. Furthermore the sun shade should show a simple construction and should be able to equip existing lying surfaces, such as lawn chairs.

This object is achieved with the characterising features of claim 1. Preferred embodiments result from the subclaims.

In principle a very simple, light-weight and therefore inexpensive embodiment consists in that the protective cover or shade is formed of a partly transparent foil, which is advantageously provided in a roll with a spring-biased and therefore automatic winding mechanism and is extended on its free leading edge via a stabilizing strip. A cover or shade of this type can be fastened on any desired point by attaching the stabilizing strip to corresponding supports into which the stabilizing strip is pressed down by the force of the tension spring of the retrieving mechanism. With the design of the supports as uniform secondary support which, just like the stabilizing strip, extends over the width of the foil, the shade consists of two separate pieces which can be separately attached and fixed.

A cover or shade of this type can be fastened, for example, to the lower end and the upper end of a lawn chair known per se. One of the many advantages is that the device can be added to a lawn chair and that the cover can be positioned at such a minimum height above the chair which is comfortable for the user. Furthermore there is no need for adjusting the shade to a certain position and it has only to be assured that the entire surface of the chair can be shaded and that not just certain areas of the body are shaded or exempt from shading. Changing the distance of the shade from the chair is important for minimizing it for the transportation of the unit. Ideally the shade would come flush with the chair, or could be lowered to a position very close to the user which offers the user protection in times of strong wind.

The roll as well as the secondary support can be put into place by means of projections being hingedly attached to their ends, on which projections there may be provided tapered rods which can be inserted into the ground, or clamps which can be attached to other equipment, particularly the frame of a lawn chair. When these projections can be collapsed in a position parallel to the roll or the secondary support for easy transportation and are furthermore adjustable in their angular position, there results a very simple manipulation.

With the help of sockets which can be used at different lengths, the shade can be adjusted to varying distances from lying surfaces or chairs. The clamps being opposite attached on the ends opposite of the cover are used for fastening tubes of different diameters by being screwed together with a suitable nut.

Due to the construction of the shade as an intrinsically stable roof surface, it is possible to attach connecting devices to the outer edges of this roof surface between the shade and the chair surface; these devices may have telescoping distance elements which can be fixed in position at any length, so that through a hinged connection of the roof surface with the lower end, for example, of a lawn chair, the cover or shade can be raised above or collapsed against the chair surface.

BRIEF DESCRIPTION OF THE DRAWINGS

An embodiment of the invention is more closely and exemplary described in the following. It is shown in.

PREFERRED EMBODIMENT

Figure 1:
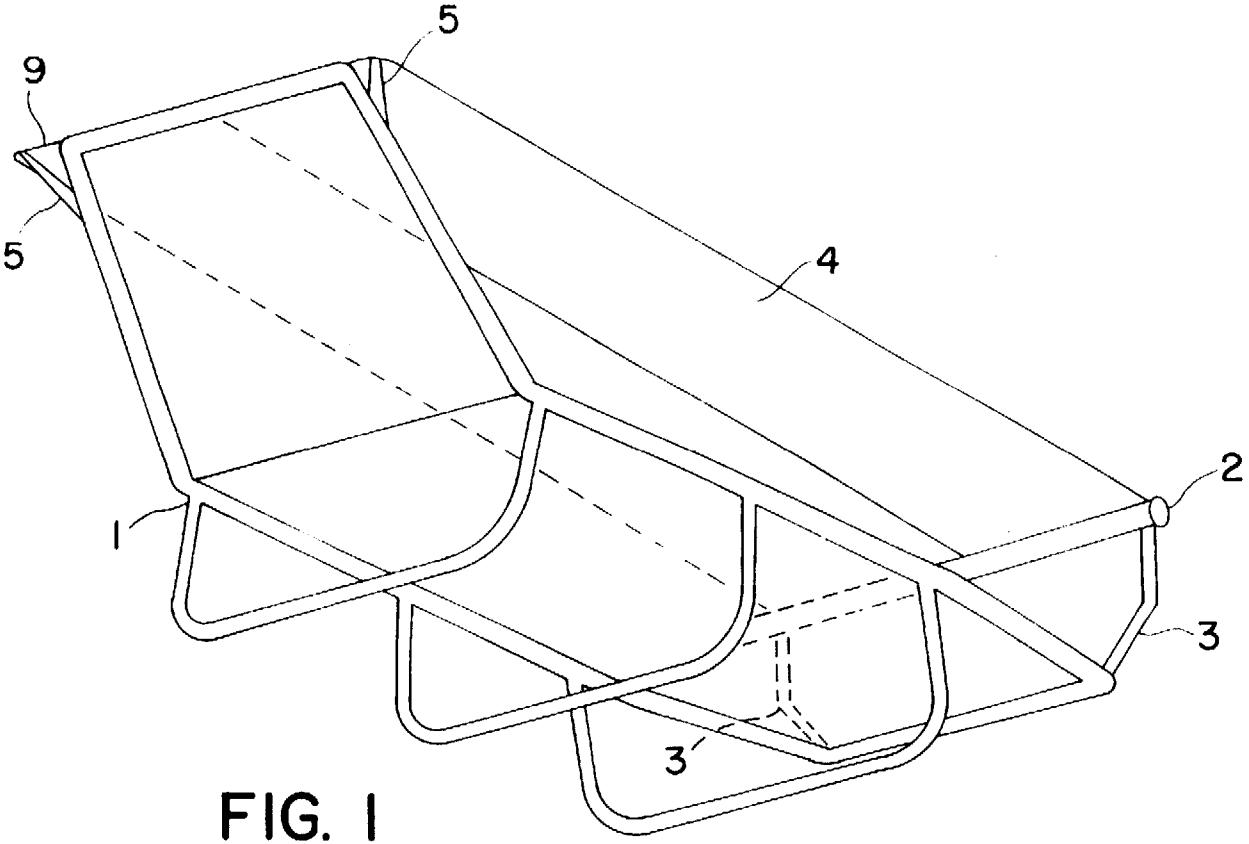
FIG. 1: the shade according to the invention on a lawn chair.

FIG. 1 shows a known lawn chair 1 on which on the lower end a roll 2 is attached approximately 30 cm above the chair surface by supports 3 perpendicular to the length direction of the chair, on which roll the protective foil is wound, which lets through UVA radiation but blocks skin-damaging UVB and UVC radiation.

On the upper end of the chair 1 there are provided supports 5 strutting upwards to which the front edge of the foil 4 being equiped with a stabilizing strip 9 can be attached. In the detailed representation of FIG. 2 these supports 5 are formed as a secondary support 11 which spans the width of the foil 4.

Figure 2:
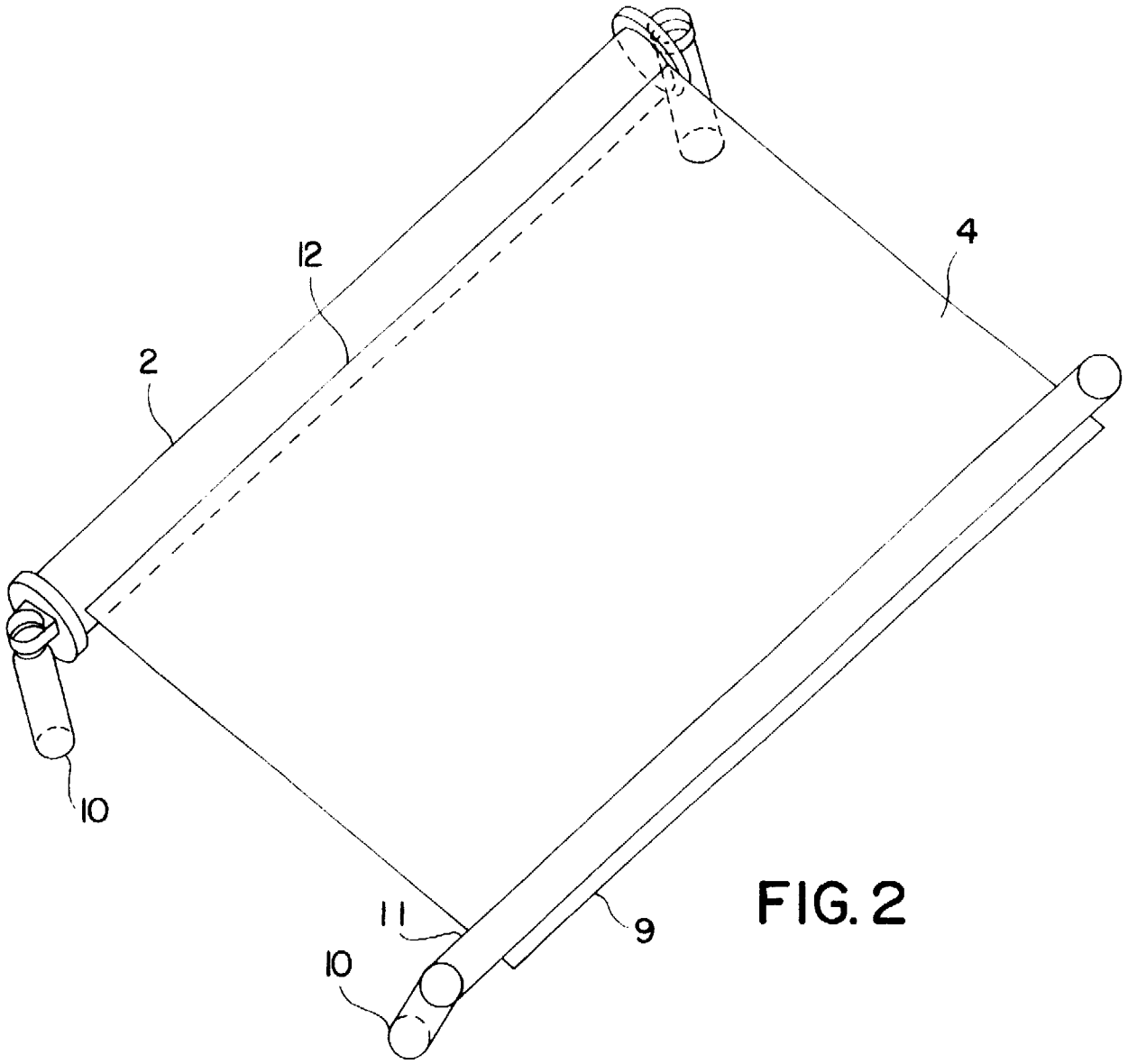
FIG. 2: the shade in detail.

Also, in FIG. 2 it is shown that the roll 2 is situated in a housing and can be pulled out through a lengthwise slit 12 according to a surface line in the cylindrical housing.

Projections extend from the ends of the roll 2 or the secondary support 11 at an angle to the longitutdinal axis of the roll or the secondary support, which projections can be lengthened by the help of sockets 10 which are depicted in FIG. 2.

Figure 3:
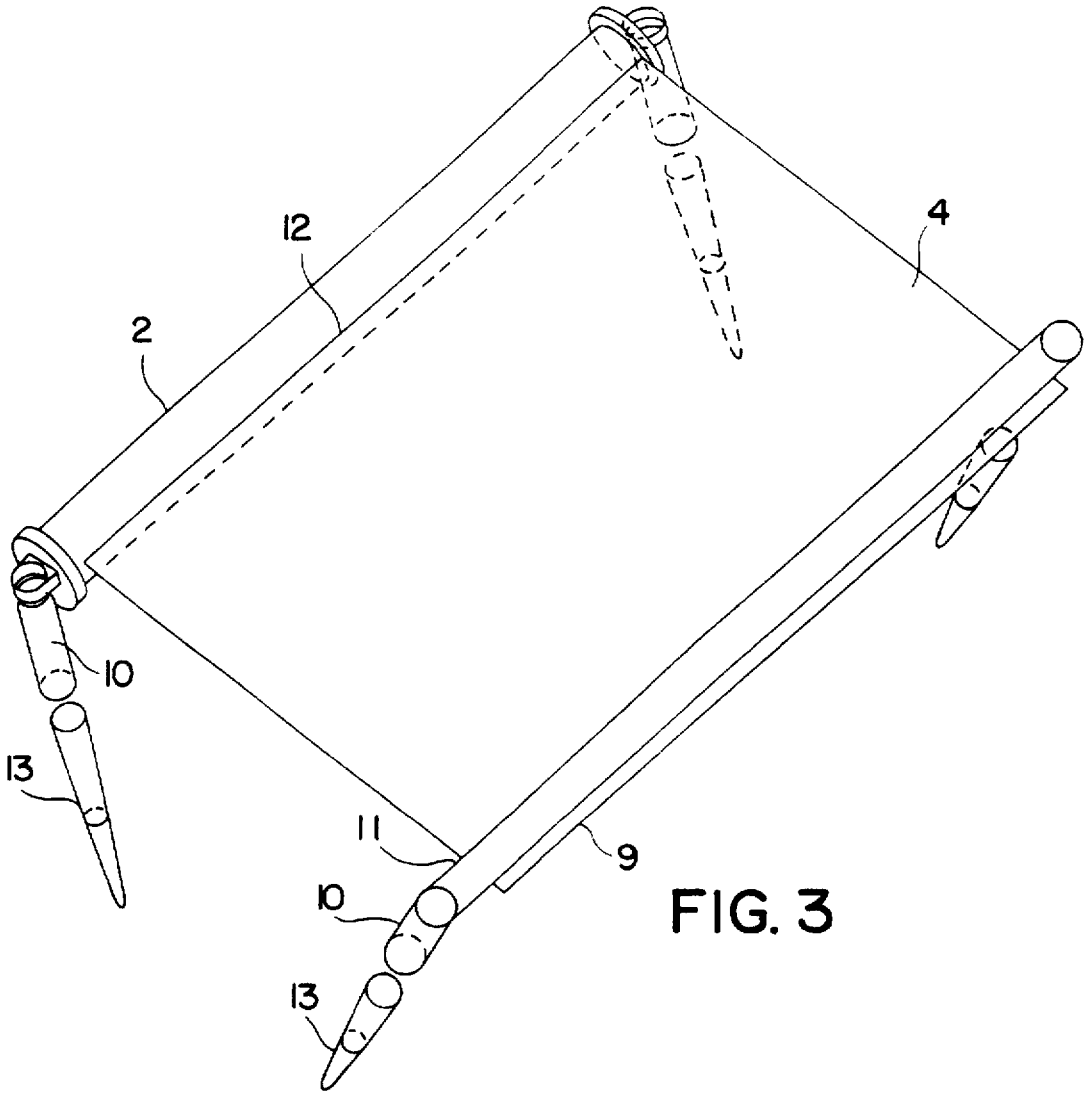
FIG. 3: the shade with rods.

On the contrary as shown in FIG. 3, in place of sockets 10, rods 13 can be attached to the projections. The rods 13 have tapered ends to facilitate being placed into the ground.

Figure 5:
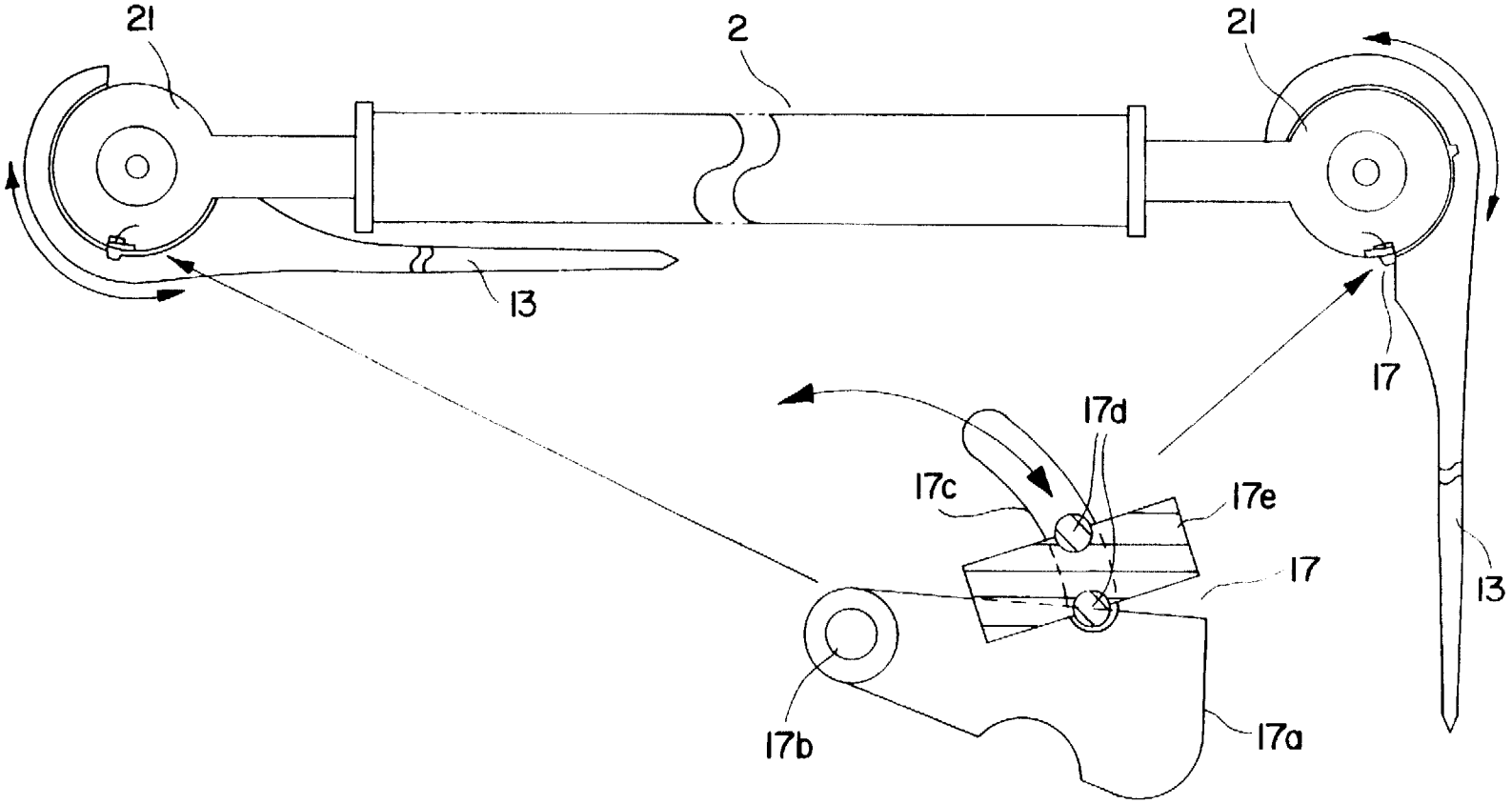
FIG. 5: the roll 2 in detail.

FIG. 5 shows one possibility in which the rods 13 are formed together with the projections as one piece. The rods 13 can be additionally rotated and therefore collapsed into a position parallel to the roll 2, making transporting easier. The variation of the angular position can be fixed by a locking device 17. The locking device 17 works by action of the locking bar 17*a*, which is fastened by the locking bolt 17*b* to the outer hinge 21. The grip 17*e*, which can be used to lock and unlock the device, is connected to the locking bar 17*a* by the guide pins 17*d*, which are guided in the guiding slit 17*c*.

Figure 4:
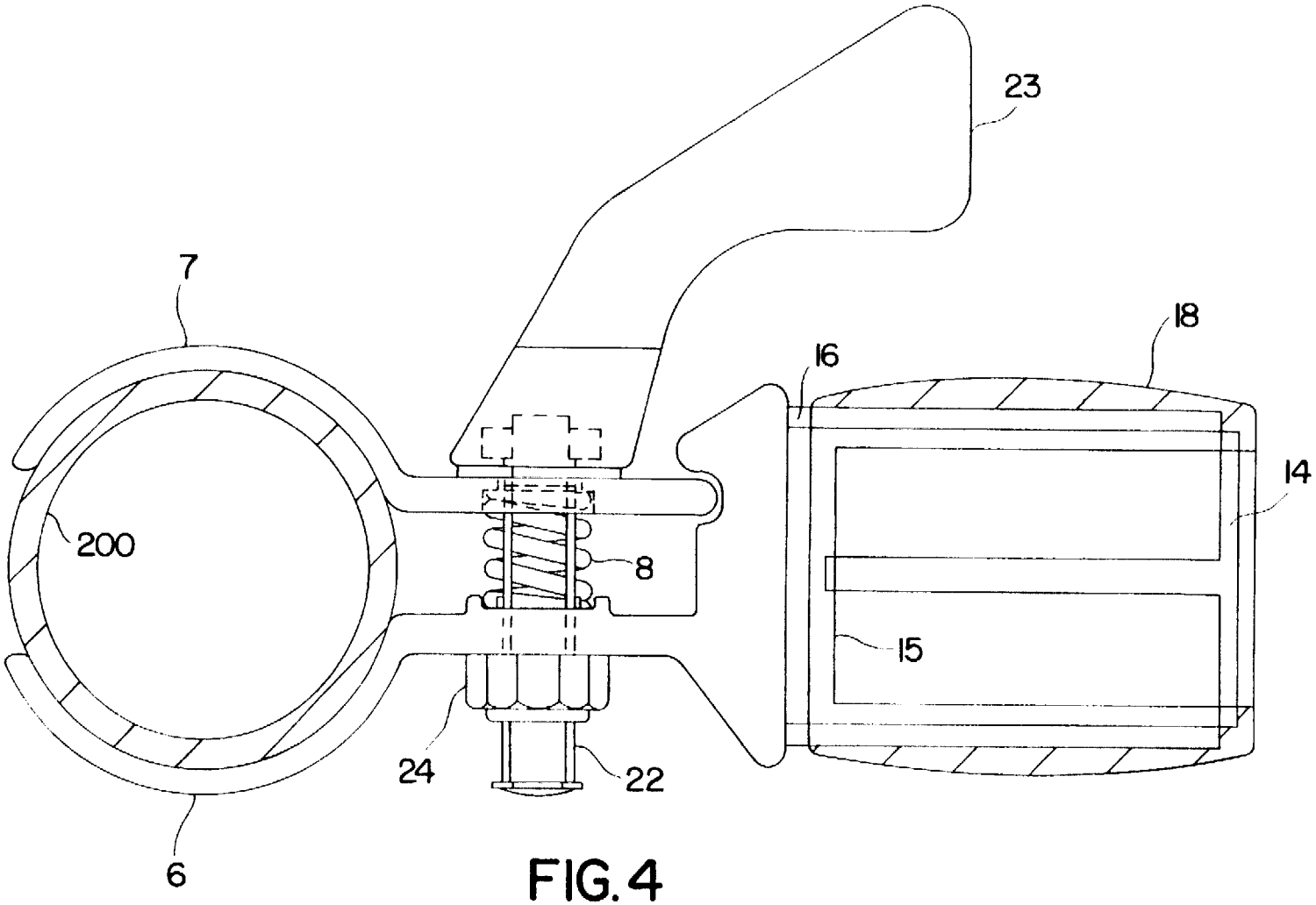
FIG. 4: clamping onto a tube.

Since the shade or cover is mounted normally over an existing lawn chair or a similar surface, the clamps shown in FIG. 4 are attached to the free ends of the sockets 10.

By screwing the lower and upper clamp parts 6, 7, respectively, and having the shape of a semi-circle on their free ends, there serve the purpose of screwing the clamp and thereby the roll 2 or the secondary support 11 to an existing tube 200, for example the tube, of a lawn chair 1.

The tightening of the clamp to tubes of different diameters is made possible due to the fact that clamp parts 6, 7 are penetrated in any suited manner. For instance a threaded bolt 22, which is attached to a handle 23 for tightening, can accordingly be screwed through clamp parts 6, 7 and into counter nuts 24. Counter nut 24 is connected with, and sunk in, the opposite clamp part 6, 7, in this case lower clamp part 6. In an opened state the upper 7 and lower 6 clamp parts can be pressed apart by a compression spring 8, which is arranged between the clamp parts and around the threaded bolt 22.

On the side of the lower clamp part 6 which is opposite the point of clamping, there is arranged a connecting sleeve for fastening the clamp with the socket 10 to the roll 2 or the secondary support 11.

It is formed as a sleeve 14 being integral with the lower clamp part, into which sleeve a flexible press sleeve 15 is housed.

In addition, an external thread 16 is situated on the sleeve 14 onto which a cap nut 18 can be screwed.

The entire sleeve is dimensioned such that a socket 10 can be inserted into the flexible press sleeve 15, and a form-tight pressing of the socket 10 against the flexible press sleeve 15 can be achieved by screwing the cap nut 18 onto the external thread 16.

Figure 6:
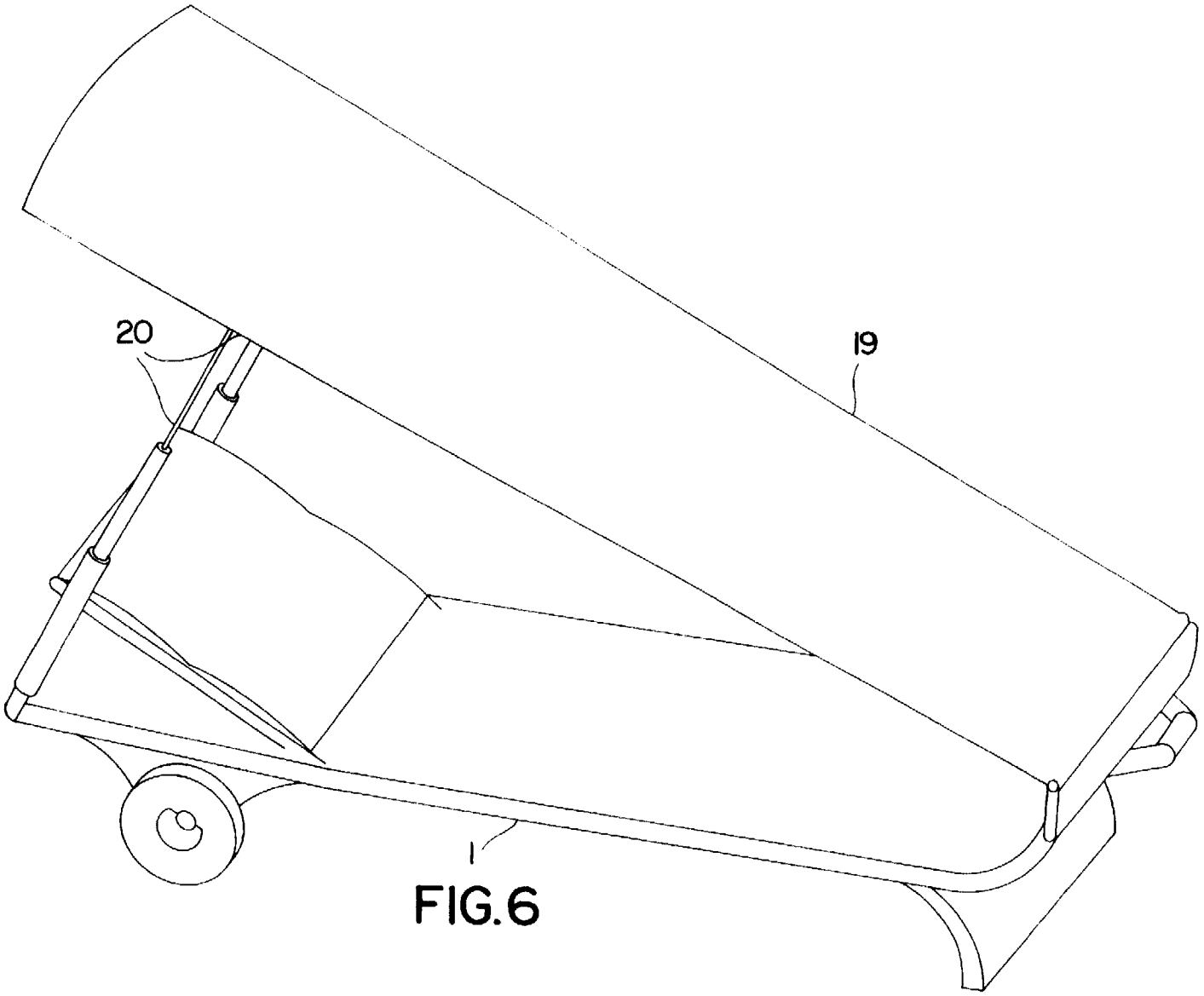
FIG. 6: the shade in the form of an attached roof.

In contrast, FIG. 6 shows a lawn chair 1 to which a stable roof surface 19 is pivotally attached at the lower end of the chair 1. Between the side braces of the roof surface 19 and the chair 1, there are arranged telescoping distance elements 20. It is possible to collapse the roof surface 19 closely against the chair 1 because the points of attaching the distance elements 20 are positioned at a different distance from the flexible connection between the roof surface 19 and the chair 1 on the lower end so that the difference of distances at least corresponds to the length of the fully-retracted supports. Thereby the chair is protected from becoming soiled and the transport of the chair 1 is made easier.

I claim:

1. A combination of sun shade and lawn chair comprising:

a foil of transparent material which is impermeable to skin-harming radiation, wherein said foil covers at least an entire base area of the lawn chair and the entire foil is situated at a distance above the lawn chair, the foil being wrapped around a roll with a spring-biased self-winding mechanism, the roll being attached above one end of the chair to a first support and is situated in a cylindrical housing having a slit through which the foil can be pulled out;

a stabilizing strip provided along a leading edge of the foil and attachable to a further support connected to an opposite end of the chair, wherein the further support is formed as a secondary support extending over the width of the foil;

hinged connecting projections extending from the ends of at least one of the housing and the secondary support onto which sockets are attached having clamps for being secured to a tube of the chair; and wherein each clamp consists of a lower clamp part and an upper clamp part, each of the upper clamp part and lower clamp part can be screwed together and which, when unscrewed, are pressed apart by a compression spring and wherein free ends of the lower and upper clamp parts are each in the shape of a semi-circle.

2. Sun shade according to claim 1, wherein the first and further supports extend at right angles to a seating surface of the chair and can be collapsed into a position parallel to the seating surface for folding up of the chair.

3. Sun shade according to claim 1, wherein on the lower clamp part there is formed a fixed sleeve, which accommodates a flexible press sleeve, and the fixed sleeve is provided with an external thread, to which a cap nut can be screwed, thereby making it possible for a socket, which is inserted into the flexible press sleeve, to be securely held.

4. Sun shade according to claim 1, wherein said transparent material comprises a pullout foil on a roll in a cylindrical housing, wherein the housing has connecting projections to receive rods for staking into the ground at one end of the chair and a secondary support is provided with further rods for staking into the ground at one opposite end of the chair to receive a leading end of the foil when it is pulled out.

5. Sun shade according to claim 4, wherein the connecting projections can be collapsed into a position being parallel and adjacent the housing.

6. Sun shade according to claim 4, wherein the connecting projections are fixable in position at an angle relative to the housing by means of a locking device.

7. Sun shade according to claim 1, wherein the shade is composed of a stable roof surface which at one end is hingedly connected to the chair and which can be adjusted at an opposite end of the chair by adjustable telescoping distance elements connected between the chair and the roof cover.

8. Sun shade according to claim 7, wherein the distance elements are constructed and configured to allow the roof surface to be folded into close proximity and parallel relation with a load bearing surface of the chair.

* * * * *